US005501323A

United States Patent [19]

Denesha et al.

[11] Patent Number: 5,501,323

[45] Date of Patent: Mar. 26, 1996

[54] SEALED DISPENSER SYSTEM

[75] Inventors: Gary L. Denesha, deceased, late of Hampden, by Michele I. Denesha, legal representatitve; Donald B. Kostanski, Hampden; Frank L. Carter, Wilbraham; Jeffrey G. Shinners, West Springfield, all of Mass.

[73] Assignee: Pioneer Packaging, Inc., Chicopee, Mass.

[21] Appl. No.: 249,634

[22] Filed: May 26, 1994

[51] Int. Cl.[6] ..... B65D 85/18

[52] U.S. Cl. ..... 206/278; 229/242; 221/63

[58] Field of Search ..... 206/278; 229/242, 229/240, 125.15, 125.33; 221/63

[56] References Cited

U.S. PATENT DOCUMENTS

| | | | |
|---|---|---|---|
| 3,024,958 | 3/1962 | Loderhouse | 229/242 |
| 3,155,273 | 11/1964 | Cote | 229/242 X |
| 3,193,137 | 7/1965 | McCarthy et al. | 206/278 X |
| 3,239,097 | 3/1966 | Bates et al. | 229/242 X |
| 3,258,156 | 6/1966 | Smith | 229/242 X |
| 3,325,003 | 6/1967 | Bilzerian | 229/242 X |
| 3,870,150 | 3/1975 | Hummel | 206/278 X |
| 3,967,756 | 7/1876 | Barish | 221/63 X |
| 4,951,815 | 8/1990 | Ulbrich | 206/278 X |
| 5,219,421 | 6/1993 | Tipping | 221/63 |

FOREIGN PATENT DOCUMENTS

| | | | |
|---|---|---|---|
| 267182 | 10/1989 | Japan | 221/63 |

OTHER PUBLICATIONS

Marilyn Bakker, The Wiley Encyclopedia of Packaging Technology 1986, pp. 443–446.

*Primary Examiner*—Allan N. Shoap
*Assistant Examiner*—Christopher McDonald
*Attorney, Agent, or Firm*—Iandiorio & Teska

[57] ABSTRACT

A sealed dispenser includes a cover having a first dispensing hole therein; a base having a second dispensing hole aligned with the first dispensing hole; and first and second flexible overlapping flaps mounted between the cover and base and covering the holes for forming a sealed barrier when the flaps are closed and permitting extraction of dispensable material when the flaps are opened.

6 Claims, 2 Drawing Sheets

SEALED DISPENSER SYSTEM

FIELD OF INVENTION

This invention relates to a sealed dispenser and more particularly to an ozone protected sealed dispenser for protecting rubber gloves.

BACKGROUND OF INVENTION

Rubber or latex gloves are being relied on more and more as protection against contamination and disease, especially with the recent concern over AIDS. Rubber gloves are used in such great quantities that their packaging is often made to double as a dispenser. Some such dispensers use simply a hole in the top of the container. Others have the hole covered by flexible sheets that abut each other along a parting line to establish a slot through which the gloves can be easily withdrawn. One problem with such devices is that they permit ozone, which is present in many environments where rubber gloves are used, to enter the box and attack the rubber gloves. Within a short period of time after exposure to ozone rubber gloves become brittle, deteriorate and are easily torn. One approach to preventing ozone from entering the container and deteriorating the rubber gloves uses a pair of overlapping flaps which cover the dispenser hole. Usually these flaps are glued to the underside of the top which bears the hole. In that construction, however, these flaps are easily dislodged or torn from their attachment to the container. This can occur when the user inserts a hand too far into the hole, thereby spreading the flaps apart excessively, or when the user grabs in such a way as to pull on one flap laterally to open the hole wide to allow the other hand to easily enter the hole and grab a glove.

SUMMARY OF INVENTION

It is therefore an object of this invention to provide an improved dispenser.

It is a further object of this invention to provide such an improved dispenser which is secure and not easily torn or detached.

It is a further object of this invention to provide such an improved dispenser which insures protection of the dispensable item against ozone and other contaminants.

It is a further object of this invention to provide such an improved dispenser which returns to an overlapping sealing configuration even after repeated use.

It is a further object of this invention to provide such a dispenser which is easily adaptable to a variety of containers to form a complete dispensing system.

It is a further object of this invention to provide such an improved dispenser which is simple and easy to make and use.

The invention results from the realization that a truly rugged dispenser which remains intact and provides a good seal against contaminants entering a dispenser system can be effected by employing a pair of overlapping resilient flaps to seal a dispenser hole in a cover and mounting those flaps between the cover and a base so the flaps cannot be easily dislodged or torn and will repeatedly return to their original overlapping position.

This invention features a sealed dispenser with a cover having a first dispensing hole therein and a base having a second dispensing hole aligned with the first dispensing hole. There are first and second flexible overlapping flaps mounted between the cover and base and coveting the holes for forming a sealed barrier when the flaps are closed and permitting extraction of dispensable material when the flaps are opened.

In a preferred embodiment the first and second dispensing holes may be congruent or the second dispensing hole in the base may be larger than the first dispensing hole in the cover. The flaps may be formed of a polyester plastic and they may be transparent. The flaps may include a metallized material disposed on the polyester plastic and the flaps may be adhered to both the base and cover.

The system also features an ozone dispenser for rubber gloves. The dispenser includes a cover having a first dispensing hole therein for dispensing rubber gloves. There is also a base having a second dispensing hole aligned with the first dispensing hole. There are first and second flexible overlapping flaps mounted between the cover and the base and covering the holes for forming an ozone sealed barrier when the flaps are closed and permitting extraction of the rubber gloves when the flaps are opened.

The system also features an ozone sealed dispenser system. The system includes a container for holding items to be dispensed. The container includes a top, a bottom, and a sidewall. The top includes a cover having a first dispensing hole therein and a base having a second dispensing hole aligned with the first dispensing hole. There are first and second flexible overlapping flaps mounted between the cover and the base and covering the holes for forming a sealed barrier when the flaps are closed and permitting extraction of the items when the flaps are open.

The system also features an ozone protected dispenser system for rubber gloves. The dispenser system includes a container for holding the rubber gloves to be dispensed. The container includes a top, a bottom and a sidewall. The top includes a cover having a first dispensing hole therein for dispensing rubber gloves and a base having a second dispensing hole aligned with the first dispensing hole. There are first and second flexible overlapping flaps mounted between the cover and the base and covering the holes for forming an ozone sealed barrier when the flaps are closed and permitting extraction of the rubber gloves when the flaps are opened.

DISCLOSURE OF PREFERRED EMBODIMENT

Other objects, features and advantages will occur to those skilled in the art from the following description of a preferred embodiment and the accompanying drawings, in which.

This invention seeks to prevent the deterioration of rubber gloves or other dispensable materials by using an ozone preventive closure over a dispenser hole in a box or other container. The closure is typically made of two overlapping pieces of clear 2-mil polyester plastic. Or, reflective, metallized polyester, which may be obtained from Metallized Products, Inc. of Winchester, Mass., could be used to further limit ozone penetration. In order to ensure that the metallized material remains adhered to the polyester, a 1-mil layer of clear polyester may be laminated on top of polyester layer carrying the metallized material. Unlike the typical dispenser box, where the plastic is simply glued onto the bottom of the cover of the box, in this invention the two overlapping pieces or flaps of plastic are sandwiched between the cover of the box and a secondary or base flap provided specifically to hold the two overlapping pieces or flaps of plastic tightly against the bottom of the cover surface. Because of this unique configuration, hundreds, even thousands of gloves or other dispensable items may be dispensed through the closure while the closure remains intact and closely sealed to prevent ozone leakage into the box or other container where it can attack and eventually deteriorate the rubber gloves or other dispensable items contained therein.

While the embodiments discussed below are directed to a complete dispenser box, the invention relates primarily to the cover of the box with the ozone preventive closure over the dispenser hole in the cover. Thus, the cover portion could be adapted to various other containers or dispensers to form a dispenser system that prevents deterioration of the dispensable items by preventing ozone from penetrating through the closure.

Figure 1:
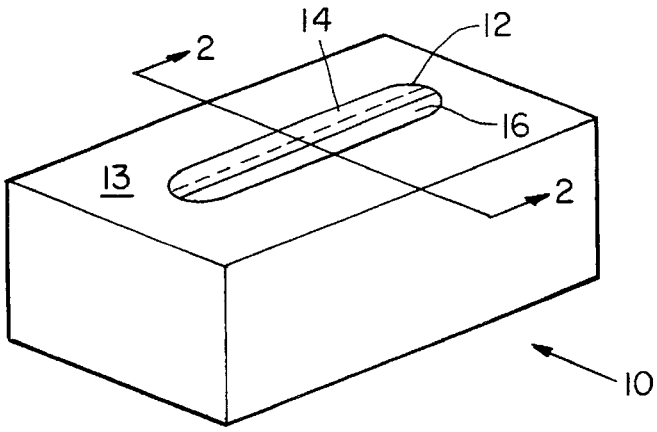
FIG. 1 is a perspective view of the sealed dispenser system of this invention.
Figure 2:
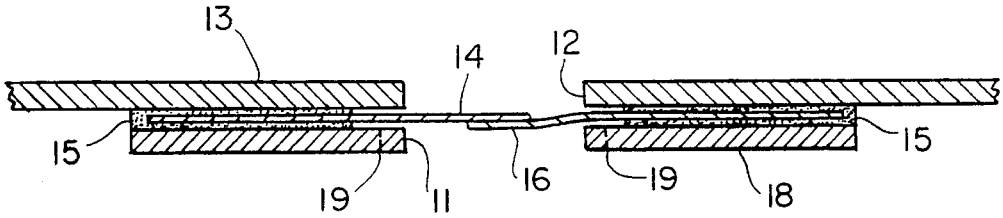
FIG. 2 is a cross-sectional view of the cover of the sealed dispenser system of FIG. 1.

In one embodiment, the box 10, FIG. 1, according to this invention includes a dispenser hole 12 in cover portion 13. Dispenser hole 12 is closed by two pieces of overlapping 2-mil polyester plastic, 14 and 16, which may be transparent or metallized. There is a base portion 18, FIG. 2, which is adhered to cover portion 13 by means of glue or any suitable form of adhesive substance. Base portion 18 and cover portion 13 sandwich the two overlapping plastic pieces or flaps 14 and 16. The flaps are adhered to either the base portion 18 or cover portion 13 or they may be glued to both the base and cover portions 13. The use of the base portion 18 adhered to cover portion 13 assures that the two pieces of overlapping polyester plastic 14 and 16 will remain engaged through long and rugged use to prevent ozone leakage into the box through the closure formed by these overlapping pieces or flaps 14 and 16 in dispenser hole 12.

Base portion 18 includes a dispenser hole 11 that may be congruent with dispenser hole 12 in cover portion 13. However, preferably the dispenser hole 11 in base portion 18 is larger than dispenser hole 12 in cover portion 13, as shown by dashed lines 19. This makes alignment of the two dispenser holes easier.

Figure 3:
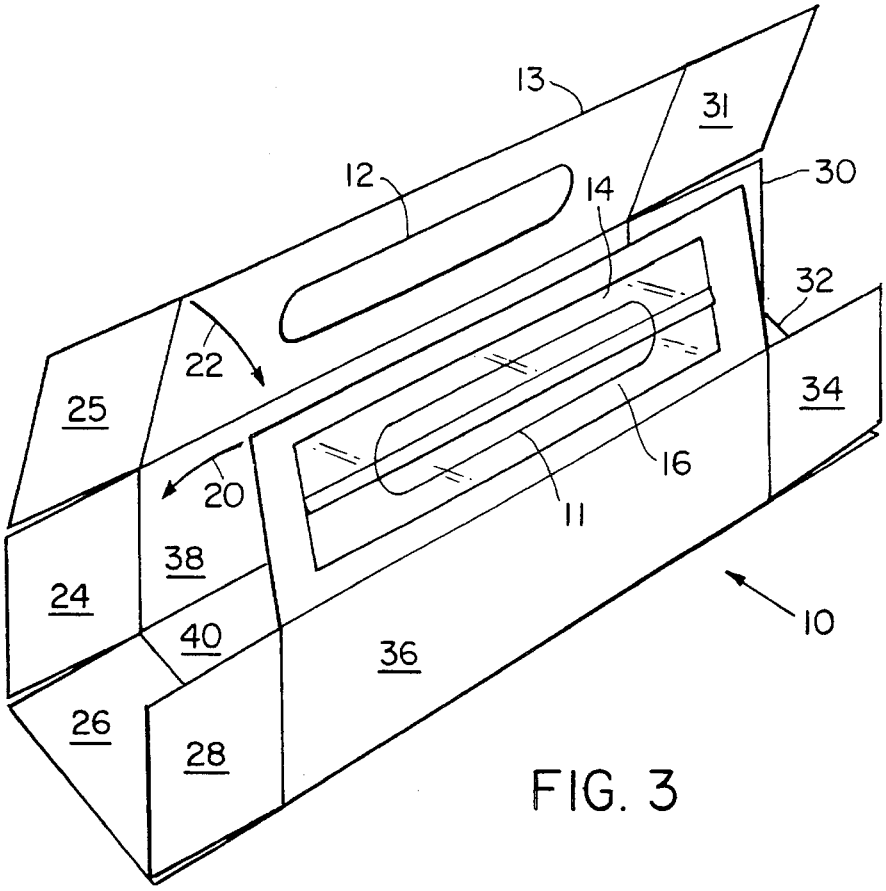
FIG. 3 is a detailed depiction of the construction and assembly of the dispenser system of FIG. 1.

Base portion 18 carries adhered to it the two plastic pieces or flaps 14 and 16, FIG. 3. The base portion 18 is folded down as indicated by arrow 20 and the cover portion 13 is then folded down in the direction of arrow 22. The cover portion 13 is adhered to the base portion 18, thereby sandwiching the two overlapping plastic pieces or flaps 14 and 16. There are also shown end flaps 24, 25, 26 and 28 at one end and end flaps 30, 31, 32 and 34 at the other end. The flaps as shown are in the opened position; however, when the box is constructed they would be folded over to form a sealed container. There are also shown sidewalls 36 and 38 and bottom portion 40.

Figure 4:
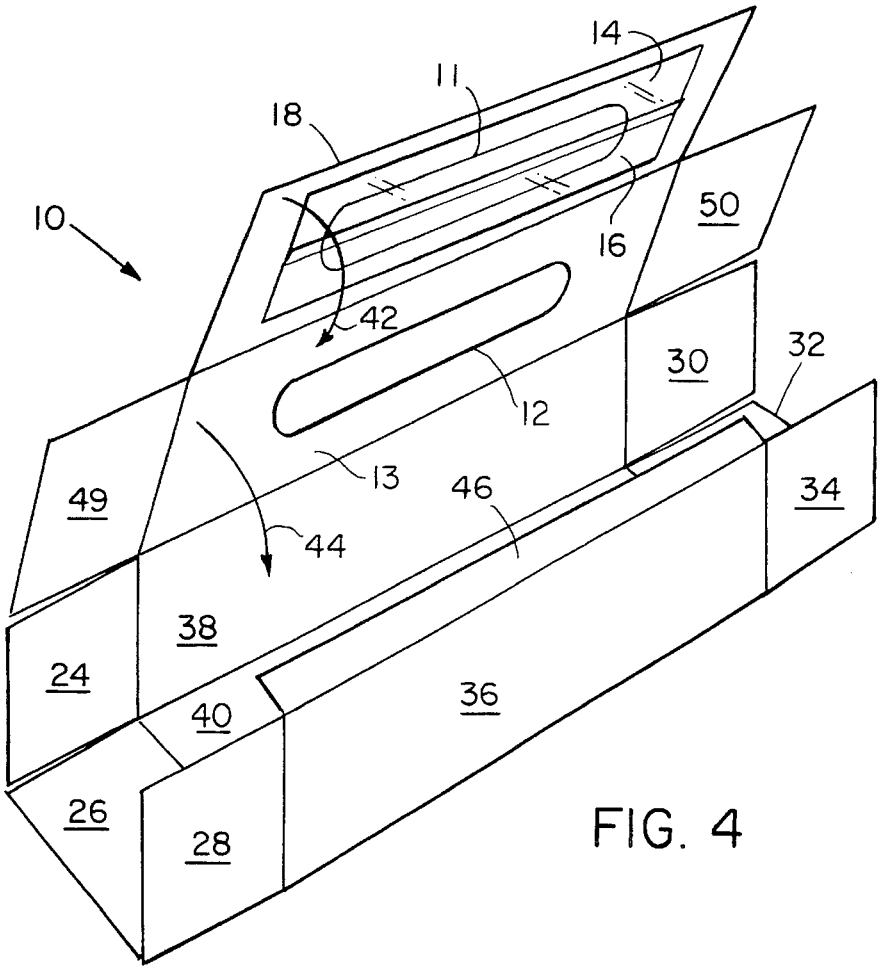
FIG. 4 is an alternative construction of the sealed dispenser system of FIG. 1.

Alternatively, FIG. 4, base portion 18 is constructed as an integral part of cover portion 13. Overlapping pieces or flaps 14 and 16 are adhered to base portion 18. Base portion 18 is folded down in the direction of arrow 42 and adhered to the bottom of cover portion 13, thereby sandwiching the two overlapping plastic pieces or flaps 14 and 16. The flaps 14 and 16 may be adhered to cover portion 13 as well. After base portion 18 and cover portion 13 have been adhered together they are folded as a unit in the direction of arrow 44 and adhered to tab portion 46.

Box 10 also includes end flaps 24, 26, 28 and 49 at one end and end flaps 30, 32, 34 and 50 at the other shown in the open position for ease of viewing. However, these flaps would be folded over to close off the ends of the box when it is assembled. There are also shown sidewalls 36 and 38 and bottom portion 40.

Figure 5:
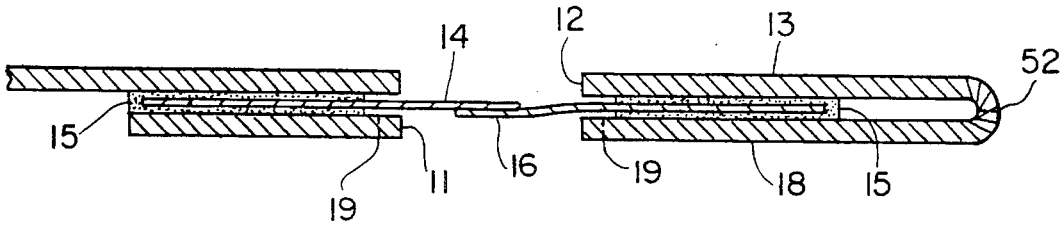
FIG. 5 is a cross-sectional view of the cover of the sealed dispenser system of FIG. 4.

Cover portion 13, FIG. 5, and base portion 18 are integrally formed but divided at the fold indicated by dashed line 52. Base portion 18 is folded at dashed line 52 and adhered to the bottom of cover portion 13 by means of adhesive 15. The two overlapping plastic pieces or flaps 14 and 16 are sandwiched between cover portion 13 and base portion 18 and are adhered thereto also by means of adhesive 15. Dispenser hole 12 in cover portion 13 and dispenser hole 11 in base portion 18 are congruent and dispenser hole 11 is larger than dispenser hole 12 as indicated by dashed lines 19.

Although specific features of this invention are shown in some drawings and not others, this is for convenience only as each feature may be combined with any or all of the other features in accordance with the invention.

Other embodiments will occur to those skilled in the art and are within the following claims.

What is claimed is:

1. A sealed dispenser comprising:

a cover having a first dispensing hole therein;

a base having a second dispensing hole aligned with said first dispensing hole such that said first and second dispensing holes are congruent; and first and second flexible overlapping flaps mounted between said cover and base and covering said holes forming a sealed barrier when said flaps are closed and permitting extraction of dispensable material when said flaps are opened.

2. The sealed dispenser of claim 1 in which said flaps are formed of a polyester plastic.

3. The sealed dispenser of claim 1 in which said flaps are transparent.

4. The sealed dispenser of claim 3 in which said flaps include a metallized material disposed on said polyester plastic.

5. A sealed dispenser comprising:

a cover having a first dispensing hole therein;

a base having a second dispensing hole aligned with said first dispensing hole wherein said second dispensing hole in said base is larger than said first dispensing hole in said cover; and first and second flexible overlapping flaps mounted between said cover and base and covering said holes for forming a sealed barrier when said flaps are closed and permitting extraction of dispensable material when said flaps are opened.

6. A sealed dispenser comprising:

a cover having a first dispensing hole therein;

a base having a second dispensing hole aligned with said first dispensing hole; and first and second flexible overlapping flaps mounted between said cover and base such that said flaps are adhered to both said cover and base and covering said holes for forming a sealed barrier when said flaps are closed and permitting extraction of dispensable material when said flaps are opened.

* * * * *